US005170213A

United States Patent [19]

Yamaguchi et al.

[11] Patent Number: 5,170,213

[45] Date of Patent: Dec. 8, 1992

[54] DEVELOPER UNIT UTILIZING A NON-MAGNETIC SINGLE COMPONENT DEVELOPER

[75] Inventors: Chiseki Yamaguchi, Kawagoe; Kazuo Otuka, Tokorozawa, both of Japan

[73] Assignee: Japan Imaging System, Inc., Japan

[21] Appl. No.: 673,277

[22] Filed: Mar. 21, 1991

[30] Foreign Application Priority Data

| | | | |
|---|---|---|---|
| Mar. 26, 1990 | [JP] | Japan | 2-82547 |
| Jan. 14, 1991 | [JP] | Japan | 3-16000 |
| Jan. 18, 1991 | [JP] | Japan | 3-18388 |
| Feb. 7, 1991 | [JP] | Japan | 3-38108 |

[51] Int. Cl.[5] ..... G03G 21/00

[52] U.S. Cl. ..... 355/246; 118/653; 355/245; 355/259

[58] Field of Search ..... 355/245, 246, 253, 259; 118/653, 656

[56] References Cited

U.S. PATENT DOCUMENTS

| | | | |
|---|---|---|---|
| 4,743,937 | 5/1988 | Martin | 355/259 |
| 4,835,565 | 5/1989 | Nagatsuna et al. | 355/259 |
| 4,947,211 | 8/1990 | Ono et al. | 355/259 X |
| 5,017,967 | 5/1991 | Koga | 355/246 X |
| 5,030,996 | 7/1991 | Tajima et al. | 355/246 |

FOREIGN PATENT DOCUMENTS

| | | | |
|---|---|---|---|
| 0273888 | 11/1988 | Japan | 355/259 |

*Primary Examiner*—A. T. Grimley
*Assistant Examiner*—William J. Royer
*Attorney, Agent, or Firm*—Ostrolenk, Faber, Gerb & Soffen

[57] ABSTRACT

A developer unit includes a porous conductive resilient member which rotates while partly contacting a developer holder to charge a non-magnetic single component developer and to supply it to the surface of the developer holder. A conductive constraining member forms a uniform thin layer of developer on the developer holder and also charges the developer to a given level. A developing bias voltage is applied to the developer holder via a rotatable fibrous charging member to cause the developer to fly to an image area of an electrostatic latent image formed on a latent image carrier which is disposed in opposing relationship with the developer holder with a gap therebetween. The bias voltage is also applied to the constraining member and to the charging member.

23 Claims, 12 Drawing Sheets

DEVELOPER UNIT UTILIZING A NON-MAGNETIC SINGLE COMPONENT DEVELOPER

FIELD OF THE INVENTION AND RELATED ART STATEMENT

The invention relates to a developer unit, and in particular, to a developer unit utilizing a non-magnetic single component developer.

Prior art techniques to develop an electrostatic latent image which may be formed by an exposure of a uniformly charged photosensitive member in accordance with image information generally include a two component developer process which uses a toner and a carrier, in particular such process utilizing a magnetic brush, which will be hereafter referred to as a two component magnetic brush developing process. However this process suffers from practical difficulties including an increased size of a resulting developer unit, the difficulty to achieve a stable mixture ratio of toner and carrier and an associated difficulty to charge the toner.

Recently, a magnetic brush developing process utilizing a single component developer in which the toner itself exhibits a magnetic property, hereafter referred to as a single component magnetic brush developing process, has been available on the market. However, while it achieves a reduction in the size of the resulting developer unit, the single component magnetic brush process presents difficulties in achieving a color image in view of the fact that a developing powder includes a magnetic powder.

In view of the foregoing, there is proposed a developing process utilizing a non-magnetic, single component developer (hereafter referred to as a non-magnetic single component developing process), which is still under investigation. This process is again categorized into a process in which the development takes place by the contact between a developer and an electrostatic latent image holder such as a photosensitive member, for example, and another process in which the developer and the latent image holder are maintained out of contact from each other while the development takes place by flying the developer to the holder.

The former or contact process results in excellent results in improving the image density and the ease of supplying a developer, but suffers from the susceptibility to the occurrence of a background fogging which is caused by the contact between the developer and the latent image holder. In addition, it exhibits a disadvantage that it cannot be adopted in a single drum, multiple color, single transfer process which is intended to achieve a simplification of an overall developer unit and a reduction in the cost in producing a color image, in view of the contacting nature of the process which gives rise to the problem of a color mixture. Accordingly, resort must be had to the latter or non-contact, flying developing process which utilizes the non-magnetic single component developer.

In a conventional developer unit which utilizes the non-contact, flying developing process, the use of the non-magnetic single component developer may cause a poor image such as a thinning or breaking of an image unless a supply of a developer to the holder, its charging, the formation of a thin layer thereof, a conveyance to a developing zone and the flying capability are properly controlled together with a satisfactory achievement of the removal, stirring action and circulation of the developer.

Considering, for example, a conventional developer unit in which a developer is charged and a thin layer is formed simultaneously by means of a constraining member such as a pressure blade, the degree to which the developer is charged cannot be stabilized in view of the triboelectric nature of charging, but undergoes a large variation subject to the material and a change in the surface condition of the constraining member, resulting in a poor reliability. In addition, a residual developer which remains on the holder after the developing step cannot be removed from the holder, and is allowed to be used again in the next following developing step as the holder rotates. In this manner, difficulties are experienced in achieving a stable charging of the developer and a satisfactory stirring action of the developer.

In a conventional developer unit which utilizes the non-contact, flying, non-magnetic single component developing process, it has been known to apply a developing bias such as an electric pulse or an a.c. bias to the developer holder in order to prevent a non-image area in the latent image from being developed, to impart a proper amount of edge effect to the image or to improve the tone quality. However, a gap g between the developer holder and the electrostatic latent image holder must be maintained very small on the order of 0.5 to 0.02 mm. If a metal holder is used which is made of a commonly used metal such as aluminium, stainless steel or the like, the choice of a high developing bias which is applied to the holder from a high voltage source will cause the liability of the developing bias to discharge, which upon occurrence, reduces the potential of the developer holder to a point near the ground potential, with consequence that a resulting low bias phenomenon occurs across the entire developer holder to produce a black transversing pattern running across the background (non-image area) of a copy or the electric breakdown of the air will produce a white dot discharge pattern in the image area, thus causing a degradation in the image quality. On the other hand, the choice of a low developing bias cannot assure a satisfactory developing capability. These difficulties can be overcome by the use of an insulating developer holder, but this results in the loss of a developing electrode effect, degrading the reproducibility of a solid black image.

To accommodate for this, there has been proposed a developer unit using a developer holder which comprises a cylindrical member formed by a conductive resin in which a conductive powder is dispersed and having openings at its opposite ends, to which a pair of end supports carrying stub shafts are coupled, with the resistivity of the conductive resin forming the cylindrical member chosen to be in a range from $10^4$ to $10^{12}$ Ω cm with a wall thickness in a range from 0.5 to 3 mm (see, for example, Japanese Laid-Open Patent Application No. 80,875/1985). In the developer unit using such developer holder, the resistivity of the conductive resin suppresses the discharge of the developing bias, and thus the choice of a high developing bias applied cannot result in the appearance of a black transversing pattern in a background (or non-image area) of a copy which might have been otherwise caused by the discharge of the developing bias. In addition, the occurrence of a discharge pattern in the form of white dots in the image area is also avoided, and the reproducibility of a solid black image is not degraded.

However, in this developer unit, the construction of the developer holder which is formed of a conductive resin and which is supported at its opposite ends by the pair of stub supports presents difficulty in securing the rigidity of the developer holder and the concentricity of the outer diameter thereof with respect to the axis. This in turn presents difficulty in maintaining a gap between the developer holder and the latent image holder to a high accuracy. Any variation in the gap is reflected in the non-uniformity of the image density. Where the developer holder has an outer diameter less than 30 mm or a length greater than 200 mm, sufficient rigidity cannot be secured, causing a flexure therein. In addition, an error in the concentricity of the outer diameter with respect to the axis will exceed 10 μm, causing a significant notability of the non-uniformity in the image density, which prevented its practical use. In addition, when a developing bias is applied to the cylindrical member, there will be produced a potential distribution lengthwise of the developer holder, which also contributes to increasing the non-uniformity in the image density.

OBJECT AND SUMMARY OF THE INVENTION

It is an object of the invention to provide a developer unit utilizing a non-magnetic single component developer in which the functions of controlling the supply, the charging, the formation of a thin layer of, the conveyance to a developing zone and the flying capability of a developer as well as the removal, stirring action and circulation of the developer are separated, and in which the charging of the developer which has been performed in the past only through the triboelectric charging operation is achieved by a positive charge injection operation by the use of a porous conductive resilient member or fibrous conductive member in combination with a constraining member to which a voltage is applied so that the developer is charged in a stable manner while improving the stirring action upon the developer to enable a stabilized developing operation which is free from any defect in the image quality.

It is another object of the invention to provide a developer unit which permits a voltage applied to a developer holder, a porous conductive resilient member or fibrous conductive member and a constraining member to be controlled to enable a proper setting of developing conditions or parameters, thereby enabling a control to be exercised over the image density in the event of any variation in the environment, in the quality of the developer or the electrical resistance of component members or a variation from lot to lot.

It is a further object of the invention to provide a developer unit which uses a developer holder carrying a conductive resin layer on its surface to prevent occurrence of a discharge of a developing bias to thereby enable a developing operation to be performed in a manner which avoids any defect in the image quality while allowing an image, free from a density non-uniformity, to be developed.

It is an additional object of the invention to provide a process of manufacturing a developer holder in a facilitated manner and to a high accuracy, the holder preventing the occurrence of a discharge of a developing bias to enable an image, free from a density non-uniformity, to be developed.

According to the invention, the control over the supply, the charging, the formation of a thin layer of, the conveyance to a developing zone and a flying capability of a developer as well as the removal, stirring action and circulation of the developer, which form essential steps in a developing process which utilizes a non-magnetic single component developer, are functionally separate from each other. This eliminates any instability in the developing conditions which may be caused by the triboelectric charging or a failure to take a flow condition of the developer into consideration. A developing electrode effect which is imparted to the developer holder can be advantageously established for a wide range of image varieties including a solid black image to a halftone image. Suitable developing conditions may be established which are adapted to the production of thin lines, in particular. In this manner, the reliability of the developing process can be improved by achieving a stabilized image quality. In addition, the invention exhibits a stabilized characteristic against environment by the use of a charge injection technique rather than the triboelectric charging technique which is greatly influenced by the environment factors or the surface condition of the material.

The developer unit is internally constructed such that the porous conductive resilient member or fibrous conductive member is effective to feed the developer, so that in the event a foreign matter is present in admixture, it is only allowed to reach the top portion of such conductive member, but is prevented from proceeding into the following step, thus assuring an enhanced reliability in this respect.

The developer holder comprises a metal carrier or core which is coated by a conductive resin layer. This reduces a change upon the image quality when a developing bias is applied to the developer holder and allows a fogging-free and sharply defined image to be obtained. The likelihood of a discharge is eliminated if a high voltage is applied as a developing bias. In addition, a high precision can be mechanically maintained for a developer holder of a reduced diameter and an increased length.

A cylindrical member of conductive resin is fitted over and secured to the surface of the metal carrier, allowing a developer holder to be produced at a high accuracy and at a low cost through a mass production. The resulting developer holder is effective to prevent a discharge from the developing bias and to produce an image which is free from a non-uniformity in the image density.

DETAILED DESCRIPTION OF PREFERRED EMBODIMENTS

Figure 1:
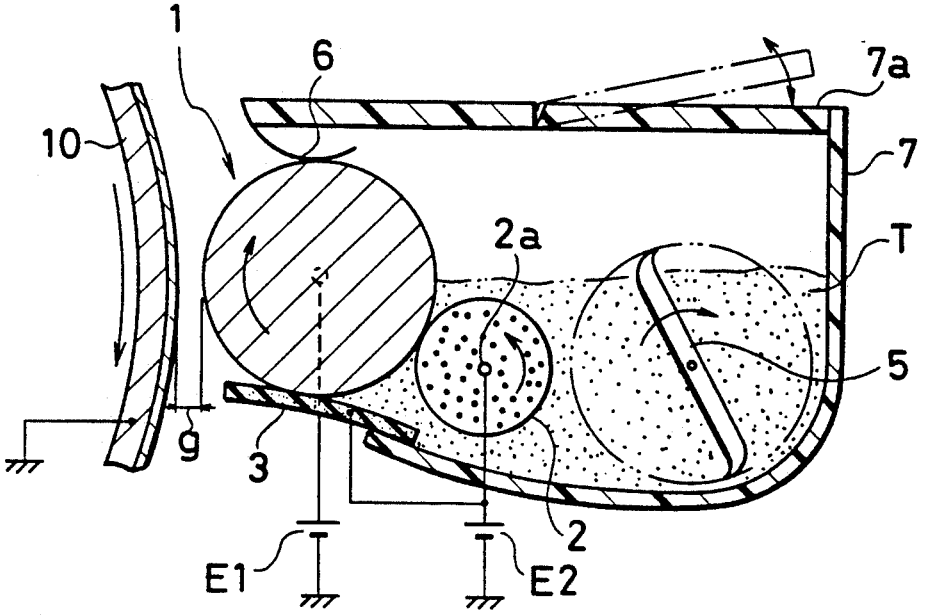
FIG. 1 is a schematic cross section of a developer unit according to a first embodiment of the invention.

FIG. 1 is a cross section of a developer unit according to a first embodiment of the invention. A developer unit according to this embodiment comprises a developer holder 1 which is rotatably supported in opposing relationship with a photosensitive member (electrostatic latent image carrier) 10 on which an electrostatic latent image is formed with a gap g therebetween, a porous conductive resilient member 2 which is rotatably mounted and partly maintained in contact with the developer holder 1, a conductive constraining member 3 for controlling the thickness of a layer of non-magnetic single component developer T to form a thin layer of developer T on the developer holder 1 and for charging the developer T to a given level, a stirring paddle 5 for stirring the developer T which is contained in a developer supply station, an anti-spill cover 6 for preventing the developer T from spilling over the top of the developer holder 1, a developer vessel 7 for defining a developer supply station and on which the members mentioned above are mounted, a high voltage source E1 connected to the developer holder 1, and another high voltage source E2 connected to the porous member 2 and the constraining member 3.

The developer holder 1 is formed by a shaft of a metal such as aluminium or stainless steel.

The porous conductive resilient member 2 comprises a roll of a material such as soft polyurethane foam having a three dimensional skelton structure and containing conductive carbon and which is formed on a metal shaft 2*a* which is supported in a rotatable manner by the sidewalls of the developer vessel 7. The porous member 2 is bonded to the metal shaft 2*a* by utilizing a conductive adhesive such as silver (Au) filler containing epoxy adhesive or carbon filler containing acrylic adhesive. The porous member 2 has a resistivity on the order of $10^3$ to $10^6$ Ω cm and hence there can be no leakage between the high voltage source E2 to which the porous member 2 is connected and the high voltage source E1 to which the developer holder 1 is connected, allowing high potentials to be independently maintained on the porous member 2 and the developer holder 1. The developer T is charged to the same polarity as the polarity of the high voltage source E2. The porous member 2 has a porosity level, which may be from 15 to 45 pores or cells per 25 mm. It is found that the porous member 2 preferably has a contact depth (or depth of engagement) with respect to the developer holder 1 on the order of 0.5 to 1.0 mm in consideration of the efficiency of conveying the developer T and the removal of the developer T which may remain on the developer holder 1 subsequent to the developing process.

The constraining member 3 is formed of a silicone rubber sheet having a hardness from 60° to 80° and which is made electrically conductive by a dispersion or attachment of conductive material (for example, conductive carbon), the member having a thickness on the order of 2 to 3 mm. The constraining member 3 abuts against the developer holder 1 in its body portion or in both body and edge portion, and is effective to control the thickness of a layer of the developer T formed on the developer holder 1 so that the thickness may be on the order of 20 to 40 μm while charging the developer T to a given level. The constraining member 3 has a resistivity on the order of $10^3$ to $10^{10}$ Ω cm, and accordingly there occurs no leakage between the high voltage source E2 to which the constraining member 3 is connected and the high voltage source E1 to which the developer holder 1 is connected, allowing given high potentials to be maintained independently on the constraining member 3 and the developer holder 1.

The stirring paddle 5 is not limited to any particular configuration, but preferably is shaped to achieve an effective stirring action and circulation of the developer T in the developer supply station defined within the developer vessel 7 without forming any stagnation or built-up of the developer T therein.

Anti-spill cover 6 is suitably formed of a urethane rubber sheet having a thickness on the order of 0.02 mm.

The developer holder 1, the porous member 2 and the stirring paddle 5 are connected together through gears, not shown, outside the developer vessel 7, and are driven for simultaneous rotation in directions indicated by arrows as the developing process is started.

In operation, as the developing process is started, the developer holder, the porous member 2 and the stirring paddle 5 begin to be driven to rotate in respective directions indicated. A quantity of the developer T which is contained in the developer supply station defined within the developer vessel 7 tends to be conveyed, as indicated by an arrow a in FIG. 2, by the rotation of the porous member 2 into an area of contact between the porous member 2 and the developer holder 1 where the developer T is charged by the porous member 2 which is connected to the high voltage source E2.

Figure 2:
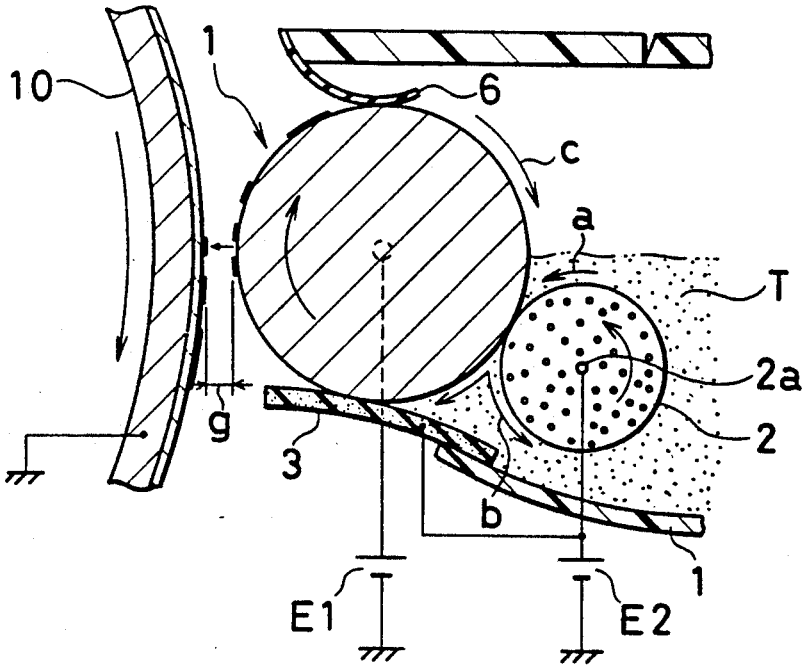
FIG. 2 is a sectional view, to an enlarged scale, of part of the developer unit shown in FIG. 1, illustrating a flow of a developer.

The charged developer T moves in a manner indicated by arrows b shown in FIG. 2 as both the developer holder 1 and the porous member 2 rotate. Specifically, part of the charged developer T is conveyed to form a thin layer on the developer holder 1 while being controlled by the constraining member 3 to a thickness on the order of 20 to 40 μm and is charged to a given level by the constraining member 3. The force which attracts the developer T to the developer holder 1 is a mirror image force acting between the charge of the developer T and the developer holder 1.

A thin layer of the developer T which is formed on the developer holder 1 is conveyed to a developing zone as the developer holder 1 rotates in order to develop an electrostatic latent image formed on the photosensitive member 10. When so conveyed, it will be located opposite to the photosensitive member 10 with a distance (which is equal to the gap g minus the thickness of the layer of developer T).

The developer holder 1 is connected to a high voltage source E1. It will be seen that because in the developing zone, a surface charge density in an image area of the electrostatic latent image formed on the photosensitive member 10 is different from a corresponding density in a non-image area of the latent image, the electrostatic force of attraction $F=qE$ (where q represents the charge of developer T and E represents the electric field in the developing zone) will be different between the image area and the non-image area. As a consequence, the developer T will fly beyond the developer holder 1 and toward the photosensitive member 10 for purpose of developing, only in the region of the image area.

It is to be noted that a choice of a peripheral speed of the developer holder 1 which is greater than that of the photosensitive member 10 is an effective technique to assure an image density.

An amount of developer T which remains on the developer holder 1 without being utilized in the developing process will be conveyed toward the anti-spill cover 6 as the developer holder 1 rotates so as to be received again within the developer supply station defined within the developer vessel 7. The anti-spill cover 6 is disposed in abutment against the developer holder 1, but such abutment takes place by a curve portion thereof which is held in gentle contact with the developer holder, and accordingly the developer T will be allowed to move into the vessel 7 without being scraped off the developer holder 1 by the cover 6.

The developer T remaining on the developer holder 1 and which is conveyed into the developer vessel 7 will be conveyed toward the porous conductive resilient member 2, as indicated by an arrow c, which member is effective to scrape it from the developer holder 1, allowing the scraped developer to be conveyed toward the stirring paddle 5 disposed within the vessel 7, in the manner indicated by an arrow b in FIG. 2, as the porous member 2 rotates. The developer T will then be again stirred and circulated through the vessel 7 for repeated contribution to the developing process.

The choice of a peripheral speed of the porous member 2 greater than that of the developer holder 1 is effective to improve the scraping effect upon the developer T which remains on the developer holder 1, and also contributes to the action of the porous member 2 which supply the developer T to the developer holder 1 and charges it in preparation to the next following developing cycle. It will be seen that the described operation is repeated to run a developing process.

As the developer T is consumed, and a fresh quantity thereof is to be replenished to the developer supply station within the developer vessel 7. This may take place by opening a feed lid *7a* or by utilizing a cartridge.

It will be seen that in the developer supply station within the developer vessel 7, residual developer T and fresh developer T will be in admixture. However, since it is only that portion of the developer T subject to contact and a conveying action of the porous member 2 and the constraining member 3 which contributes to the deposition of the developer T upon the photosensitive member 10, the degree of charging can be controlled by such member, achieving a stabilized degree of charging irrespective of the history of the developer T. This in turn stabilizes the force $F=qE$ with which the developer T flies to the image area during the developing process, thus achieving a stabilized image quality.

While the high voltage source E2 is shown as a d.c. source, it is also effective to utilize a superimposed d.c. and a.c. source in order to prevent the agglomeration of the developer T while improving its conveying capability. However, if the a.c. is used in superimposition, the source still requires a d.c. component in order to prevent the polarity of the developer T from changing.

Figure 3:
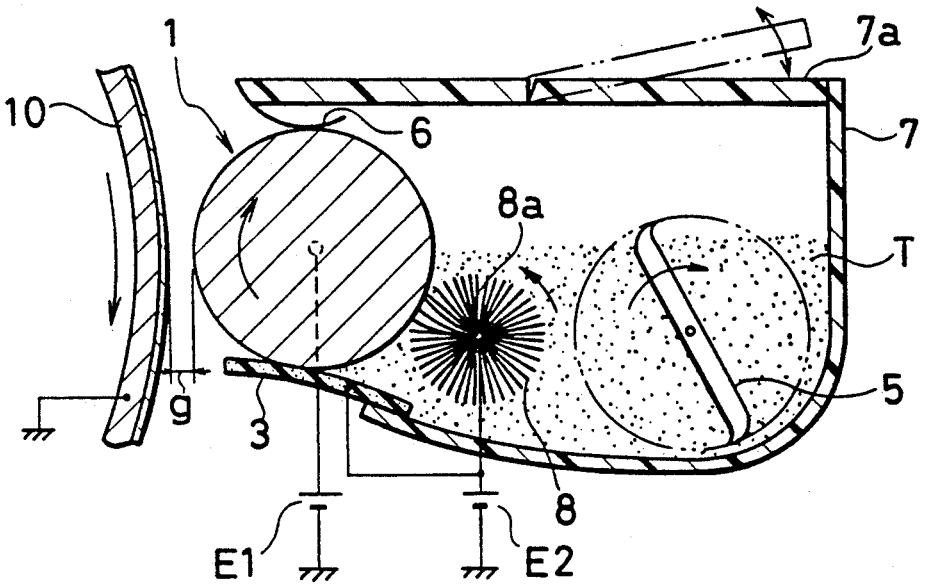
FIG. 3 is a cross section of a developer unit according to a second embodiment of the invention.

FIG. 3 is a cross section of a developer unit according to the second embodiment of the invention. In this embodiment, the porous member 2 used in FIG. 1 is replaced by a fibrous conductive member 8. In other respects, the arrangement is similar to that of the first embodiment shown in FIG. 1 and accordingly, corresponding parts are designated by reference numerals or characters, and the repeated description will be omitted.

Specifically, the fibrous conductive member 8 is in the form of a brush comprising either a conductive resin fibre such as nylon or rayon in which a conductive carbon is dispersed or a conductive resin fibre such as nylon or rayon having a core of conductive material. The fibre may be made conductive by a post-processing step such as depositing fine particles of conductive carbon to the surface thereof. The thickness of the conductive resin fibre may be 100 to 2,000 denier/100 fibres, or each fibre may be on the order of 1 to 20 denier where one denier corresponds to the thickness of a fibre when one gram of the material is extended to a length of 9,000 m. A suitable density will be on the order of 10 to $1,000\times10^3$ fibres per inch square.

The fibrous conductive member 8 is formed as a brush mounted on a metal shaft 8*a* which is rotatably supported by the sidewalls of the developer vessel 7, in the similar manner as the porous member 2. The fibrous conductive member 8 may be bonded to the metal shaft 8*a* by utilizing a conductive adhesive such as silver (Au) filler containing epoxy adhesive or carbon filler containing acrylic adhesive as is the case with the porous member 2.

The intended purpose of the fibrous conductive member 8 may be served by choosing a depth of contact between the fibrous conducting member 8 and the developer holder 1 on the order of 0.5 to 2.0 mm.

The number of revolutions of the fibrous conductive member 8 depends on its diameter, but its peripheral speed is chosen to be equal to or greater than that of the developer holder 1 as in the case with the porous member 2.

The developer unit of the second embodiment operates in the similar manner as that shown in FIG. 1, and therefore will not be described.

Figure 4:
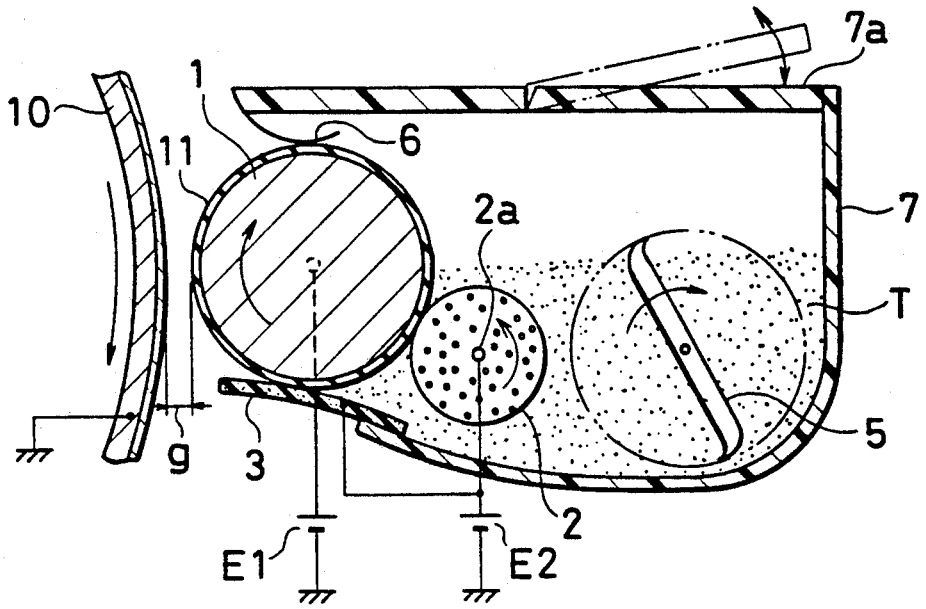
FIG. 4 is a cross section of a developer unit according to a third embodiment of the invention.

FIG. 4 is a cross section of a developer unit according to a third embodiment of the invention. In this embodiment, the developer holder 1 is provided by forming a dielectric layer 11 on the surface of a metal shaft which carries the developer holder 1, which remains the same as in FIG. 1. In other respects, parts shown in FIG. 4 are similar to those shown in FIG. 1, and accordingly are designed by like numerals and characters for purpose of avoiding a repeated description.

The dielectric layer 11 may be formed of a polymer material such as polyester, polyethylene, polyvinylidene fluoride, polypropylene or the like, and desirably has a thickness on the order of 50 to 100 μm. By providing a dielectric material in the form of electret, it may be rendered effective in preventing the developer T sputtering in addition to serving the conveyance of the developer T and development.

The developer unit of the third embodiment operates substantially in the similar manner as the developer unit of the first embodiment shown in FIG. 1, but the presence of the dielectric layer 11 results in a different nature of force acting upon the developer T. Specifically, the developer T which is conveyed by the porous member 2 upon initiation of the developing process will be held attracted to the developer holder 1 as a result of its charging the dielectric layer 11 on the developer holder 1 together with the porous member 2 connected to the high voltage source E2 and the constraining member 3 as the developer T itself is charged by the members 2 and 3. It should be noted that the dielectric layer 11 is in effect charged by the charged developer T, and accordingly the force of attraction acting upon the developer T to the developer holder 1 will be an electrostatic force, rather than a mirror image force which was effective in the developer unit of the first embodiment.

The electric resistance of the porous member 2, the constraining member 3 and the dielectric layer 11 as well as the potential of the high voltage source E2 are chosen so that the potential of the porous member 2 and the constraining member 3 near their surface is greater in absolute magnitude than the surface potential of the dielectric layer 11.

In the developer unit of the third embodiment, the relationship between the various potentials should be such that (1) For reversal development,

|the potential of image area of electrostatic latent image| < |the potential of developer holder| < |the surface potentials of porous member and constraining member|

(2) For normal development,

|the potential of developer holder| < |the surface potentials of porous member and the constraining member| ≦ |the potential of image area of electrostatic latent image|

While the residual developer T on the developer holder 1 is subject to the action of the porous member 2 to be removed therefrom, the surface potential of the dielectric layer 11 remains unchanged, which is effective to achieve a more stabilized deposition of the developer T upon the developer holder 1 in the next following developing process.

It will be noted that the developer unit of the third embodiment may require at least one revolution of the developer holder 1 to charge the dielectric layer 11 before the developing step can take place, but this presents no problem whatsoever.

In the developer unit of the third embodiment, it is also advantageous for the purpose of assuring a favorable supply of the developer T to choose a peripheral speed of the porous member 2 which is equal to or greater than that of the developer holder 1, as in the first embodiment shown in FIG. 1.

It is also to be noted that in the developer unit of the third embodiment, the porous conductive resilient member 2 may be replaced by the fibrous conductive member 8 shown in FIG. 3.

Figure 5:
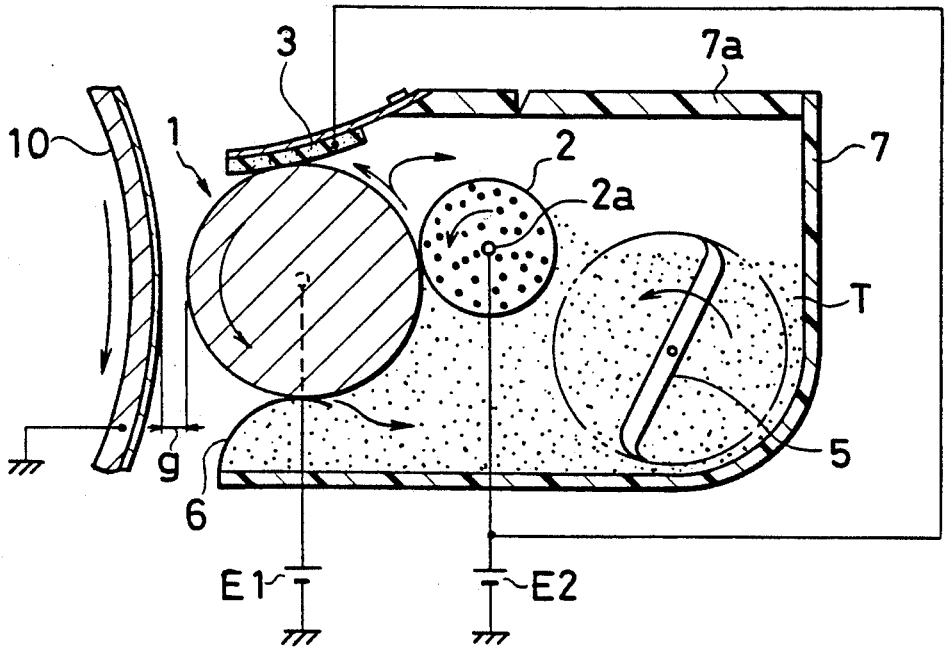
FIG. 5 is a cross section of a developer unit according to a fourth embodiment of the invention.

FIG. 5 is a cross section of a developer unit according to a fourth embodiment of the invention. In the developer unit of this embodiment, the direction of rotation of the developer holder 1 is opposite from that shown for the first embodiment shown in FIG. 1. Accordingly, because corresponding parts are similar to those used in the first embodiment shown in FIG. 1, they are designated by like numerals and will not be described in detail.

However, in the developer unit of the fourth embodiment, the constraining member 3 is disposed on top of the developer holder 1 while the anti-spill cover 6 is disposed adjacent to the bottom of the developer holder 1.

The operation of the developer unit of the fourth embodiment remains substantially similar to that of the developer unit of the first embodiment shown in FIG. 1.

The developer holder 1, the porous conductive resilient member 2 and the stirring paddle 5 rotate in directions indicated by arrows in FIG. 5, and the developer T is conveyed toward the developer holder 1 as the porous member 2 rotates. As it is being conveyed, it is charged by the porous conductive resilient member 2 which is connected to the high voltage source E2 and as it is charged, it is held attracted to the developer holder 1 by the mirror image force for its subsequent conveyance by the rotation of the developer holder 1.

The constraining member 3 forms a thin layer of developer, on the order of 20 to 40 μm and also charges the developer T to a given stable level so that it is conveyed into the developing zone as the developer holder 1 rotates. In the developing zone, the developer T is used to develop an electrostatic latent image formed on the photosensitive member 10 according to the relative force relationship as mentioned above in connection with previous embodiments, and residual developer T which was not utilized in the developing step will move past the anti-spill cover 6 as the developer holder 1 rotates to be removed therefrom by the porous member 2. Subsequently, it is subjected to a stirring and circulating action within the developer vessel 7 by the stirring paddle 5 located within the developer supply station for its use in subsequent development process.

It is to be noted that the direction of rotation of the porous member 2 shown in FIG. 5 is an example, but that the arrow may be oppositely directed so as to be capable of accommodating for a reduced amount of developer T within the developer supply station.

It is also to provide a dielectric layer 11 on the surface of the developer holder 1 in the developer unit of the fourth embodiment, as shown previously in FIG. 4.

Additionally, it is also possible to replace the porous member 2 by the fibrous conductive member 8 as shown in FIG. 3.

Figure 6:
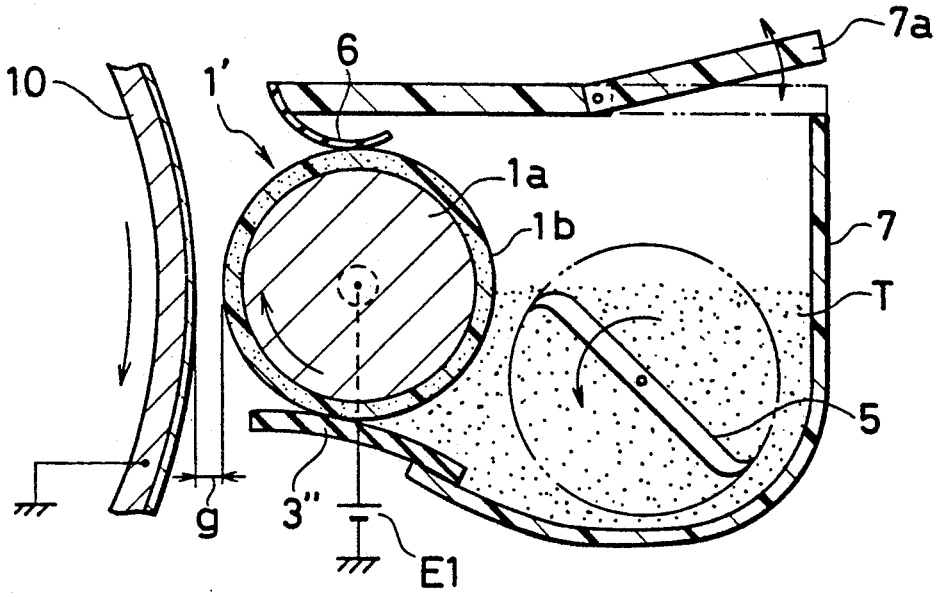
FIG. 6 is a cross section of a developer unit according to a fifth embodiment of the invention.

FIG. 6 is a cross section of a developer unit according to a fifth embodiment of the invention. In this embodiment, the developer unit comprises a developer holder 1' which is rotatably supported and which is disposed in opposing relationship with a photosensitive member 10 with a gap g therebetween, a constraining member 3'' for controlling the thickness of a thin layer of developer T which is formed on the developer holder 1' and for charging the developer T, a stirring paddle 5 for stirring developer T disposed within a developer supply station, an anti-spill cover 6 for preventing the developer T from spilling over the top of the developer holder 1', a developer vessel 7 for defining a developer supply station and on which the described parts are mounted, and a high voltage source E1 for applying a developing bias to the developer holder 1'.

Figure 7:
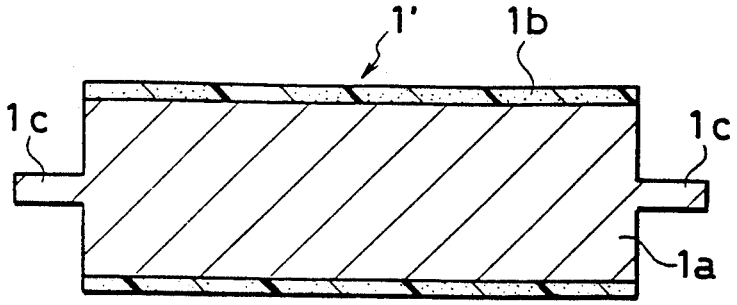
FIG. 7 is a cross section illustrating a developer holder shown in FIG. 6 to an enlarged scale.
Figure 8A:
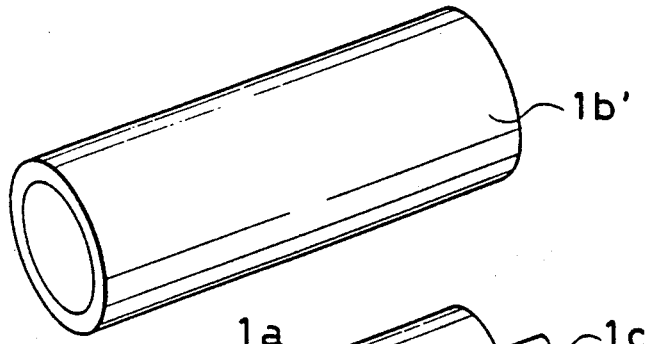
FIG. 8 (*a*), 8(*b*) 8(*c*) and 8(*d*) comprise a series of perspective views illustrating steps used to manufacture the developing holder shown in FIG. 7.
Figure 8B:
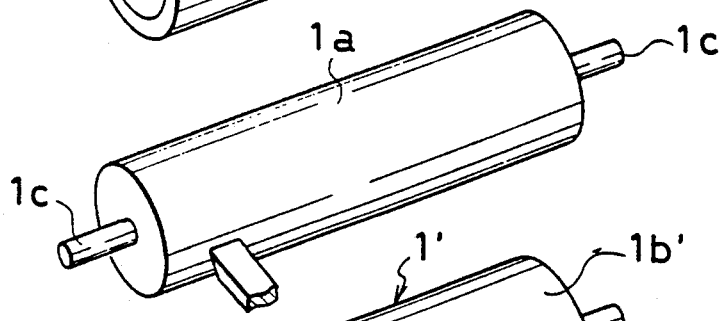
Figure 8C:
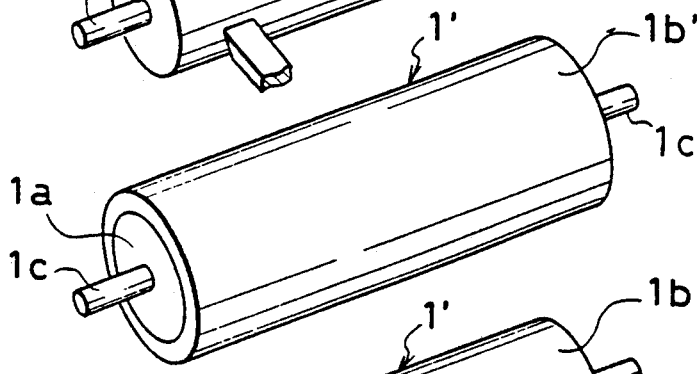
Figure 8D:
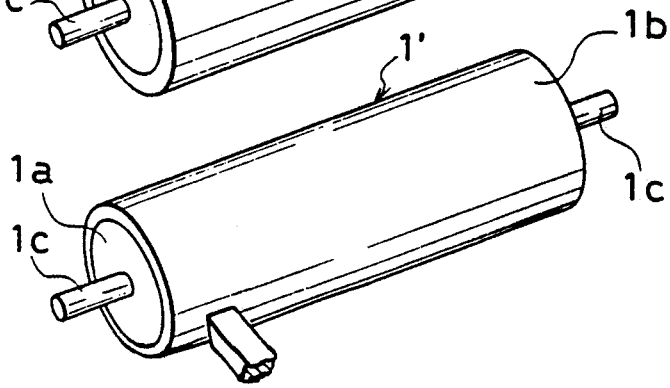

As shown in FIG. 7, the developer holder 1' comprises a cylindrical metal shaft or metal carrier 1*a* having a coating of conductive resin layer 1*b* thereon. The shaft 1*a* may be formed of aluminium, stainless steel or the like while the resin layer 1*b* may have a thickness on the order of 1.5 to 5 mm and may be formed of a resin having conductive powder dispersed therein to exhibit a resistivity on the order of $10^4$ to $10^{12}$ Ω cm. Conductive powder may comprise conductive carbon, aluminium powder or silver powder, and a resin may comprise a thermosetting resin such as phenol, urea or melamine resin or a thermoplastic resin such as polystyrene or acrylic resin.

It is possible to achieve a resistivity in a range from $10^4$ to $10^{12}$ Ω cm for the conductive resin layer 1*b* by using a dispersion of conductive powder in the resin on the order of 5 to 50 percent by weight. A coating of the conductive resin layer 1*b* on the metal shaft 1*a* is formed by initially providing a hollow-cylindrical member of conductive resin, to which the metal shaft 1*a* is bonded by using a conductive adhesive or in which the metal shaft 1*a* is positioned as a press fit.

More specifically, as shown in FIG. 8(*a*), a conductive resin which exhibits a resistivity on the order of $10^4$ to $10^{12}$ Ω cm and having a thickness on the order of 1.5 to 5 mm is initially formed into a hollow cylinder to provide a cylindrical member 1*b*' of conductive resin. Subsequently, as shown in FIG. 8(*b*), a metal shaft 1*a* carrying a pair of support stubs 1*c* at its opposite ends is polished to a high precision by a centered forced polishing operation. Then a conductive adhesive such as a silver filler containing epoxy adhesive or carbon filler containing acrylic adhesive which has a resistivity equal to or less than $10^4$ Ω cm is applied to the surface of the metal shaft 1*a* as shown in FIG. 8(*c*), and then the cylindrical member 1*b*' is fitted over the metal shaft 1*a*. Finally, the centered forced polishing operation is again used to achieve a thickness of 1.5 to 5 mm for the conductive resin layer 1*b* and a tolerance of concentricity equal to or less than 10 μm for the outer diameter of the developer holder 1' as referenced to the outer diameter of the support stubs 1*c* located on the opposite ends of the metal shaft 1*a*. In this manner, there is obtained a developer holder 1' having a resistivity on the order of $10^4$ to $10^{12}$ Ω cm, high rigidity and exhibiting a high dimensional accuracy. Since the metal shaft 1*a* extends lengthwise through the developer holder 1', a non-uniformity of the potentials distributed lengthwise thereof can be avoided.

It is noted that while the degree of the circularity of the external diameter of the developer holder 1' thus formed is slightly inferior to that of a developer holder 1 which is formed of a metal shaft alone, the presence of the conductive resin layer 1*b* thereon makes the resulting developer holder 1' permissible for practical purposes. Since no mechanical strength is required of the conductive resin layer 1*b* itself, accommodation for a reduced diameter or an increased length can be met by the configuration of the metal shaft 1*a*.

To give an example, a developer holder 1' may be formed to an external diameter of 30 mm by utilizing a stainless steel shaft 1*a* having a diameter of 24 mm which is then coated by a conductive resin layer 1*b* having a thickness of 3 mm and having a resistivity of $10^5$ Ω cm which is attained by dispersion of conductive carbon in phenol resin. The resulting developer holder 1' is driven at the peripheral speed of 100 mm/sec, for example, in the direction shown by the arrow.

A conductive resin layer 1*b* having a resistivity in a range of from $10^4$ to $10^{12}$ Ω cm may be formed on the metal shaft 1*a* by coating the metal shaft 1*a* with polyurethane or polyester resin having a dispersion of conductive powder such as conductive carbon, aluminium powder or silver powder so as to achieve a resistivity on the order of $10^4$ to $10^{12}$ Ω cm. However, the application of the conductive resin layer 1*b* by the coating step may result in an insufficient adhesion of the conductive resin layer 1*b* to the metal shaft 1*a*, causing an exfoliation after a prolonged period of use. In addition, the coating technique is not practical in view of the increased cost and the likelihood of producing pinholes. It is also contemplated that the metal shaft 1*a* be eliminated completely, and a cylindrical member 1*b*' formed of conductive resin having a resistivity on the order of $10^4$ to $10^{12}$ Ω cm as a result of dispersion of conductive powder and which is free from flanges at its opposite sides may itself serve as a developer holder. However, in this instance, the application of a voltage from the source E1 will not be uniform lengthwise of the developer holder. In particular, for a developer holder having an external diameter equal to or less than 30 mm or having a length equal to or greater than 200 mm, the insufficient rigidity of the material may cause a flexure of the developer holder, and in addition, it becomes difficult to maintain the circularity of the developer holder which is directly related to an non-uniformity in the image density which is of paramount importance to the developer unit, thus presenting difficulties in their practical use.

The developer holder 1' is located in the opening of the developer vessel 7 which contains an amount of developer T as a developer supply station, and the developer holder 1' is coated with the developer T by an application roller, not shown. The constraining member 3'' comprises a sheet of polyurethane rubber having a thickness of 3 mm and a rubber hardness of 60°, for example, and is disposed in abutment against the developer holder 1'.

In operation, as the developer holder 1' and the stirring paddle 5 rotate in directions indicated by arrows, the developer T in the developer supply station within the vessel 7 will be conveyed to form a thin layer under the control of the constraining member 3'' to achieve a thickness on the order of 20 to 40 μm, and will be triboelectrically charged to the positive polarity by a sliding contact with the developer holder 1' and the constraining member 3''. The force which causes the adhesion of the developer T to the developer holder 1' will be electrostatic in nature in this instance.

The thin layer of developer T which is formed on the developer holder 1' will be conveyed, as the developer holder 1' rotates, into the developing zone where it is in opposing relationship with the photosensitive member 10 rotating at the peripheral speed of 50 mm/sec, for example, in a direction indicated by arrow, with a distance therebetween which is equal to gap g minus the thickness of layer of developer T.

A developing bias of +500 V, d.c. for example, is applied to the developer holder 1' from the high voltage source E1, and because the surface charge density is different between an image area and a non-image area of the latent image on the photosensitive member 10 in the developing zone, the developer T will fly from the developer holder 1' toward the photosensitive member 10 and deposited thereon only in the region of the image area for purpose of development. A resistivity in a range from $10^4$ to $10^{12}$ Ω cm, preferably around $10^8$ Ω cm, of the conductive resin layer 1b on the developer holder 1' yields a favorable development over a range of image varieties from a solid black to a halftone image while suppressing an excessive transfer of developer T. The effect of any fluctuation in the output from the high voltage source E1 is diminished by the resistance which the conductive resin layer 1b on the developer holder 1' exhibits, reducing its influence upon the image quality.

The developer T on the developer holder 1' which is left without being used in the developing process will be recovered into the developer supply station within the vessel 7 through the anti-spill cover 6 as the developer holder 1' rotates. The described cycle is repeated to proceed the developing process.

Figure 9:
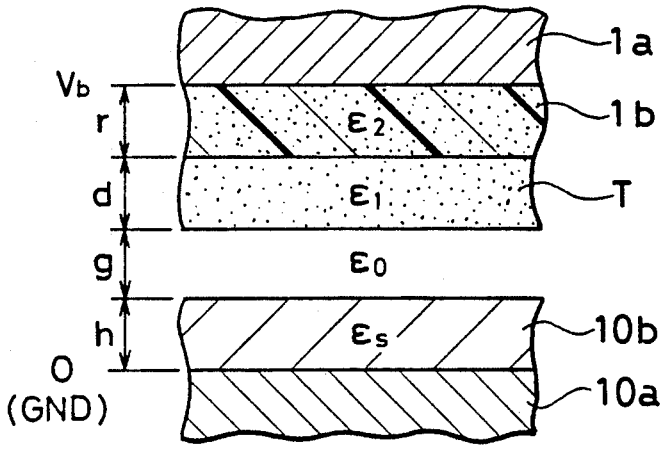
FIG. 9 is a schematic illustration of dielectric layers used in the developing zone of the developer unit of the fifth embodiment shown in FIG. 6.

It is to be noted that the principal force with which developer T on the developer holder 1' is transferred to an image area in the latent image on the photosensitive member 10 is an electrostatic force represented by $F=qE$ where q represents the charge retained by the developer T as it is conveyed from within the vessel 7 to a position on the developer holder 1' where it is disposed in opposing relationship with the latent image, and E represents an electric field proportional to a difference between the potential Vs of an image area of the latent image and a bias potential Vb applied to the metal shaft 1a of the developer holder 1' or $E=f_0\times|Vs-Vb|$ where the $f_0$ can be termed as a dielectric thickness. The dielectric thickness $f_0$ can be determined from the following equation using a cross sectional arrangement of a dielectric layer model in the developing zone as shown in FIG. 9, which is formed by the photosensitive member 10 (photosensitive layer 10b and conductive substrate 10a), developer T, gap g and the developer holder 1':

$$\frac{1}{f_0} = \frac{\epsilon_1{}^h}{\epsilon_s} + \frac{\epsilon_1{}^u}{\epsilon_0} + d + \frac{\epsilon_1{}^r}{\epsilon_2} \quad (1)$$

where r, d, g and h will be the thicknesses of the conductive resin layer 1b, the thin layer of developer T, the gap g and the photosensitive layer 10b, and $\epsilon_2$, $\epsilon_1$, $\epsilon_0$ and $\epsilon_s$ represent the dielectric constants of the conductive resin layer 1b, the layer of developer T, the gap g and the photosensitive layer 10b. By using relative dielectric constants, these dielectric constants can be rewritten as $\epsilon_1=\epsilon_0\,\epsilon_{1'}$, $\epsilon_s=\epsilon_0\epsilon_{s'}$ and $\epsilon_2=\epsilon_0\,\epsilon_{2'}$. The equation (1) can then be rewritten as follows:

$$\frac{1}{f_0} = \epsilon_{1'}\left(\frac{h}{\epsilon_{s'}} + g + \frac{d}{\epsilon_{1'}} + \frac{r}{\epsilon_{2'}}\right) \quad (2)$$

For a developer holder 1 free of a conductive resin layer, the dielectric thickness $f_0$ can be defined as follows:

$$\frac{1}{f_0} = \epsilon_{1'}\left(\frac{h}{\epsilon_{s'}} + g + \frac{d}{\epsilon_{1'}}\right) \quad (3)$$

Figure 10:
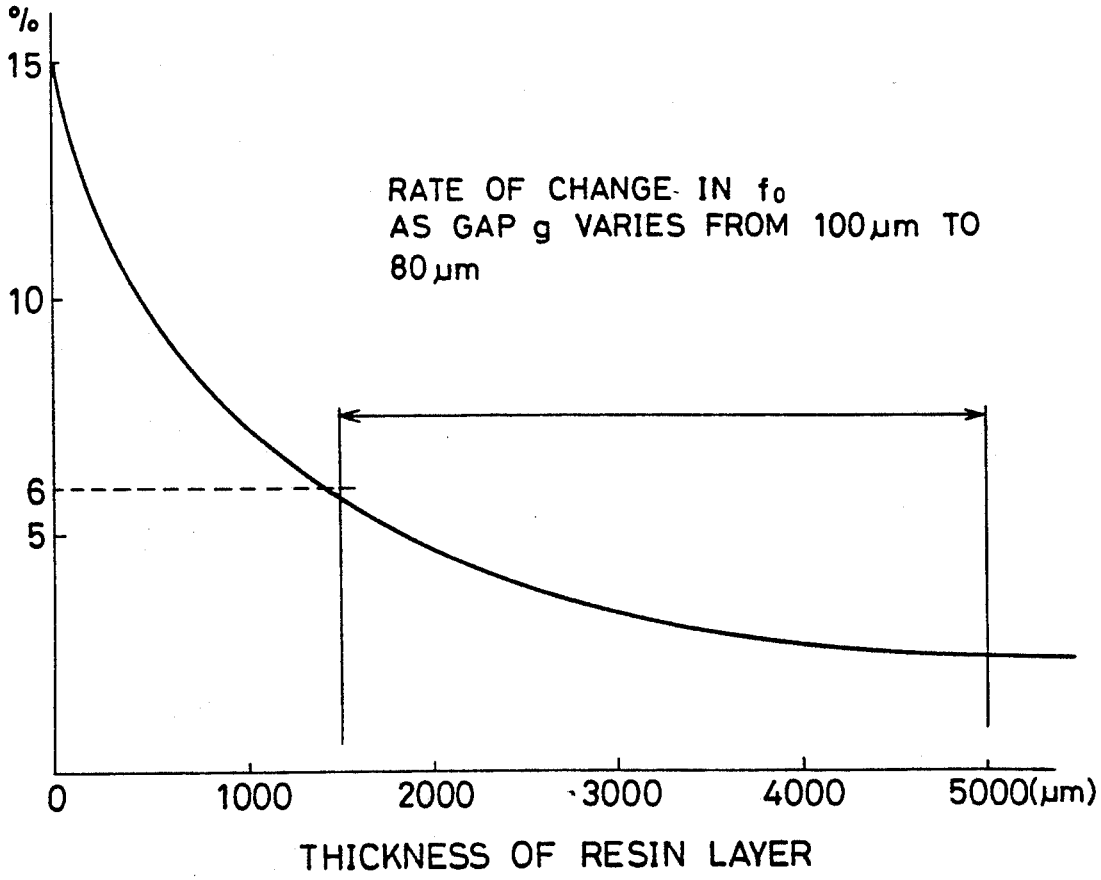
FIG. 10 graphically shows a rate of change in the thickness of a dielectric layer as a gap changes in a dielectric layer model shown in FIG. 9.

Substituting values of these parameters obtained in an actual developer unit into the equation (2), i.e., $\epsilon_{1'}=1.5$, $\epsilon_{s'}=7$, $\epsilon_{2'}=7$, h=50 μm, g - 100 μm and 80 μm, d=40 μm, r=5,000 μm, 3,000 μm, 1,000 μm, 500 μm and 0 μm to derive a rate of change in $f_0\{f_0(80\ \mu m)-f_0(100\ \mu m)\}/f_0(80\ \mu m)$ as the gap g changes from 100 μm to 80 μm, there can be obtained a graph as shown in FIG. 10. The purpose of choosing a change of the gap g between 100 and 80 μm in the graphical illustration in FIG. 10 is to consider a resulting change in the electric field E when the gap g varies due to mechanical accuracy of the developer holder 1'. The rate of change in $f_0$ is plotted against the thickness r of the conductive resin layer 1b in this graph over 0 to 5,000 μm in order to recognize the influence of the thickness (including the presence and absence) of the conductive resin layer 1b.

Considering the graphical illustration of FIG. 10, which indicates the rate of change in the dielectric thickness $f_0$ for a change in the gap g over varying thickness r of the conductive resin layer 1b, it will be seen that the rate decreases with an increase in the thickness of the conductive resin layer 1b. This means that the use of the conductive resin layer 1b on the developer holder 1' is effective to allow the accuracy which is required in machining the developer holder 1' to be alleviated than when no conductive resin layer is used. Accordingly, a developer holder 1' having a conductive resin layer 1b is seen to be more suitable for its mass production while reducing the manufacturing cost.

A proper value of the thickness r of the conductive resin layer 1b will now be considered. Where no conductive resin layer is provided (r=0), it is necessary for the permissible development that a variation in the gap g remains within 8 μm, which can be converted into the rate of change in the dielectric thickness $f_0$ as follows:

$$\{f_0(92\ \mu m)-f_0(100\ \mu m)\}/f_0(92\ \mu m)\div 0.06\ (6\%).$$

Accordingly, if the gap g changes by 20 μm, it is seen from FIG. 10 that the thickness r of the conductive resin layer 1b is equal to or greater than 1,500 μm or 1.5 mm in order to achieve a satisfactory development for practical purposes. In addition, it is required that the developer holder 1' itself should achieve a tolerance of concentricity of its external diameter as referenced to the external diameter of the support stubs 1c located on the opposite end of the metal shaft 1a which is equal to or less than 10 μm in consideration of the accuracies of related parts and assembly operation.

A reduction in the absolute value of the dielectric thickness $f_0$ which is caused by an increase in the thickness r of the conductive resin layer 1b causes a reduction in the strength of the electric field E, which can be accommodated for by controlling the developing bias Vb. However, it will be noted from FIG. 10 that a decrease in the rate of change in the dielectric thickness $f_0$ with an increase in the thickness of the conductive resin layer 1b is greatly reduced as the thickness further increases. In addition, an increased thickness of the conductive resin layer 1b causes a difficulty in achieving the accommodation by the adjustment of the developing bias Vb. Accordingly, it is preferable for practical purposes that the thickness r of the conductive resin layer 1b is limited to or less than 5 mm. In addition, it is undesirable to use an increased thickness for the conductive resin layer 1b in order to suppress a dimensional change during the operation and storage.

If the conductive resin layer 1b is thin enough to be equal to or less than 1 mm, this is likely to cause a non-uniformity in the image density due to a non-uniform dispersion of conductive powder within conductive resin layer 1b. In addition, the non-uniformity in the image density will also be caused by a non-uniformity in the thickness r of the conductive resin layer 1b, presenting practical problems.

In an experimental development which is conducted by choosing a gap g between the developer holder 1' and the photosensitive member 10 which is less than 0.3 mm or to be equal to 0.1 mm, for example, with the resistivity of the conductive resin layer 1b on the developer holder 1' chosen to be $10^7$ Ω cm, it is found that if a discharge occurs in the presence of pinholes in the photosensitive layer 10b of the photosensitive member 10, the resulting discharge current is limited by the conductive resin layer 1b on the developer holder 1', preventing the potential of the developer holder 1' from being reduced to near the ground potential. In this manner, the occurrence of a black traversing pattern across a background of a copy, the occurrence of a discharge pattern in the form of white dots in an image area which would be otherwise produced as a result of the electric breakdown of the air or a nonuniformity in the image density of the copy is prevented.

Thus by using the conductive resin layer 1b having a thickness of 1.5 to 5 mm and exhibiting a resistivity on the order of $10^4$ to $10^{12}$ Ω cm as a coating on the metal shaft 1a to provide the developer holder 1', any discharge which would be caused by a developing bias across the developer holder 1' and the photosensitive member 10 will be suppressed by the resistivity presented by the conductive resin layer 1b on the developer holder 1', with consequence that a high developing bias applied to the developer holder 1', if chosen, does not interfere with obtaining a sharp, fogging-free image exhibiting an enhanced edge effect, a low bias phenomenon caused by a discharge of the developing bias which would produce a black traversing pattern across a background of a copy and a discharge pattern in the form of white dots across an image area can be prevented and the developer holder 1' is enabled to act as a developing electrode to prevent any loss of the reproducibility of a solid black image.

By maintaining a tolerance of the concentricity of the external diameter of the developer holder 1' as referenced to the external diameter of the support stubs 1c disposed at the opposite ends of the metal shaft 1a which is equal to or less than 10 μm, the rigidity of the developer holder 1' is sufficient to maintain the gap g between the developer holder and the photosensitive member 10 to a high accuracy, enabling the development of an image which is free from a non-uniformity in the image density. Since the developer holder 1' comprises a coating of the conductive resin layer 1b around the metal shaft 1a, there resulted no potential distribution lengthwise of the developer holder 1', which would have caused a nonuniformity in the image density.

Since the cylindrical member 1b' of conductive resin is fitted over and secured to the peripheral surface of the metal shaft 1a, the developer holder 1', which is rendered incapable of producing a non-uniformity in the image density by preventing a discharge of the developing bias, can be provided at a reduced cost and at a high accuracy by means of a mass production.

Figure 11:
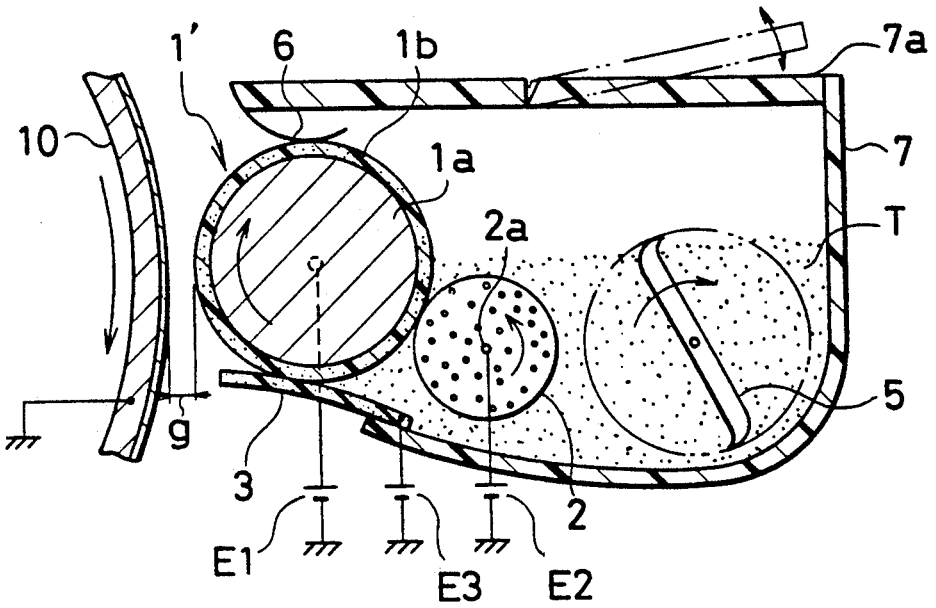
FIG. 11 is a cross section of a developer unit according to a sixth embodiment of the invention.

FIG. 11 is a cross section of a developer unit according to a sixth embodiment of the invention. The developer unit of this embodiment is a modification of that shown in FIG. 1 in that the developer holder 1' used in the developer unit of the fifth embodiment (shown in FIG. 7) is used as the developer holder 1 and separate high voltage sources are used, including a high voltage source E2 associated with the porous member 2 and a high voltage source E3 associated with the constraining member 3. It is to be noted that the polarity of the source E3 is chosen to be of the same polarity as the polarity to which the developer T is charged. In other respects, the arrangement is similar to those shown in FIG. 1, and accordingly corresponding parts are designated by like reference numerals or characters and will not be described in detail.

The developer unit of the sixth embodiment operates substantially similarly as the developer unit of the first embodiment shown in FIG. 1. However, the force which attracts the developer T to the developer holder 1' is an electrostatic force acting between the charge of the developer T and the conductive resin layer 1b on the developer holder 1'.

Figure 12A:
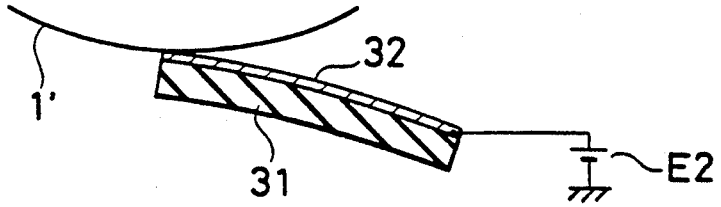
FIGS. 12(*a*), 12(*b*) and 12(*c*) are a series of cross sections illustrating a sequential deformation of the constraining member shown in FIG. 11.

In FIG. 11, the constraining member 3 has been illustrated as a single member. However, the construction of the constraining member 3 is not limited thereto, and it may be constructed in different configurations as illustrated in FIGS. 12(*a*), (*b*) and (*c*). The only requirement is that a portion of the constraining member 3 including a surface which abuts against the developer holder 1' exhibits a given resistivity and is adapted to allow the application of a high voltage thereto. Any separate member may be used to support such portion so as to enable the mechanical abutment of such portion against the developer holder 1', and still the assembly can function as the constraining member 3. In FIG. 12(*a*), the constraining member 3 comprises a conductive material 32 on the surface of a resilient member 31 which may be formed of urethane rubber. The conductive material 32 may be coated on the resilient material 31, but a bonding by means of an adhesive or a mechanical attachment is preferred in view of the useful life and the stability. In FIG. 12(*b*), the constraining member 3 comprises a block of conductive material 34 secured to the free end of a resilient metal plate 33 which may be formed of phosphor bronze or spring steel. In FIG. 12(*c*), the constraining member 3 comprises a conductive material 37 applied to the surface of a resilient member 36 which is in turn secured to a resilient metal plate 35 which may be formed of phosphor bronze or spring steel.

Figure 13:
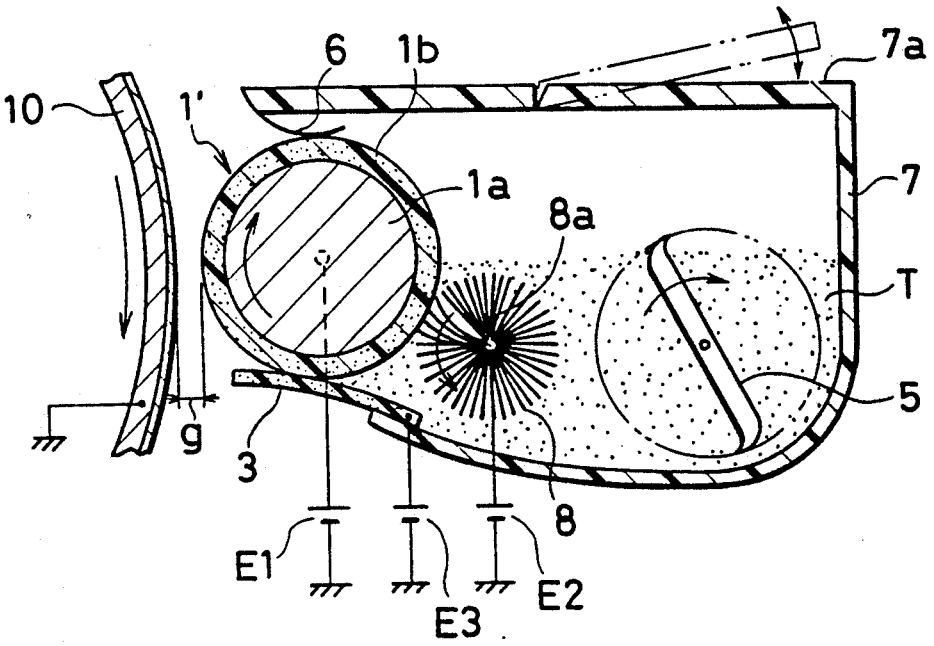
FIG. 13 is a cross section of a developer unit according to a seventh embodiment of the invention.

FIG. 13 is a cross section of a developer unit according to a seventh embodiment of the invention. In this embodiment, the porous member 2 used in the sixth embodiment shown in FIG. 11 is replaced by the fibrous conductive member 8 used in the second embodiment shown in FIG. 3. In other respects, the arrangement is similar to that of the sixth embodiment, and accordingly, corresponding parts are designated by like reference numerals and characters and will not be described in detail. Again, this embodiment operates in the similar manner as the sixth embodiment shown in FIG. 11.

Figure 14:
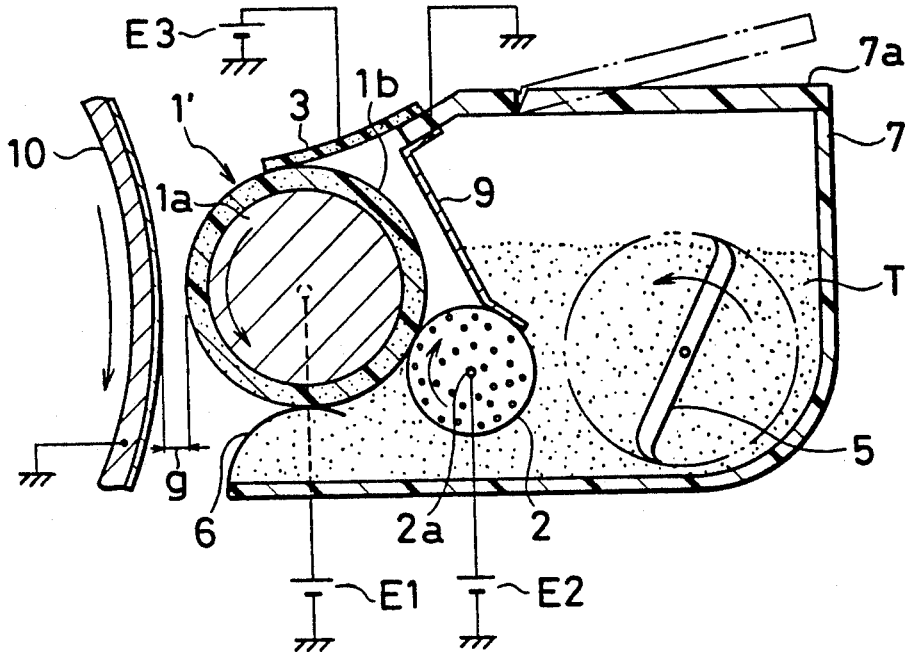
FIG. 14 is a cross section of a developer unit according to an eighth embodiment of the invention.

FIG. 14 is a cross section of a developer unit according to an eighth embodiment of the invention where the direction of rotation of the developer holder 1' in the developer unit of the sixth embodiment shown in FIG. 11 is reversed. Accordingly, the arrangement of this embodiment is similar to that of the sixth embodiment shown in FIG. 11 unless otherwise specified, and accordingly corresponding parts are designated by like reference numerals or characters and will not be described.

In the developer unit of the eighth embodiment, the constraining member 3 is disposed on top of the developer holder 1' while the anti-spill cover 6 is disposed alongside the bottom of the developer holder 1'. A partition 9 is disposed on top of and above the porous conductive resilient member 2 disposed within the developer vessel 7 for preventing the developer T distributed around the stirring paddle 5 from moving directly to the developer holder 1' without being previously engaged by the porous member 2. In addition, the partition 9 is effective to introduce such portion of the developer T, which has been blocked from being conveyed into the developing zone as the constraining member 3 defines a thin layer as well as that portion of the developer T which is scraped off the developer holder 1' which remained after the development, into the developer vessel 7 to the region of the stirring paddle 5.

The partition 9 may be formed of a resin, for example, but is preferably formed of a metal which is then connected to the electrical ground in consideration of the charge of the developer T and the subsequent charged condition of the developer T. If placed in contact with the porous conductive resilient member 2, the partition 9 cannot cause a leakage of a high voltage from the source E2 because of the resistivity of the porous member 2 which is on the order of $10^3$ to $10^6$ Ω cm.

The developer unit of the eighth embodiment operates in substantially the same manner as the developer unit of the sixth embodiment shown in FIG. 11.

In the developer unit of the eighth embodiment, it is possible to replace the porous member 2 by the fibrous conductive member 8 as used in the seventh embodiment shown in FIG. 13. In addition, the direction of rotation shown for the porous member 2 is exemplary only, and it may rotate in the opposite direction. The presence of the partition 9 is also preferred in this instance.

For the developer units of the sixth to eighth embodiments, experiments have shown that images of a favorable quality has been obtained under the conditions indicated below:

| | |
|---|---|
| gap g | 0.1 mm |
| resistivity of conductive resin layer 1b | $10^{10}$ Ω cm |
| peripheral speed of developer holder 1 | 75 mm/sec |
| resistivity of porous conductive resilient member 2 (or fibrous conductive member 8) | $10^4$ Ω cm |
| peripheral speed of porous conductive resilient member 2 (or fibrous conductive member 8) | 125 mm/sec |
| resistivity of constraining member 3 | $10^6$ Ω cm |
| voltage of source E1 | 500 V |
| voltage of source E2 | 600 V |
| voltage of source E3 | 400 V |
| peripheral speed of photosensitive member 10 | 50 mm/sec |
| voltage of image area on photosensitve member 10 | 50 V |
| voltage of non-image area on photosensitive member 10 | 600 V (reversal development) |

It is possible to exercise a control over the image density depending on the relative magnitude of the voltage of the sources E1, E2 and E3. For example, by choosing a relationship such that |voltage of source E2| > |voltage of source E1|, the image density can be increased. The image density can also be increased by choosing a relationship such that |voltage of source E3| < |voltage of source E1|.

Figure 15:
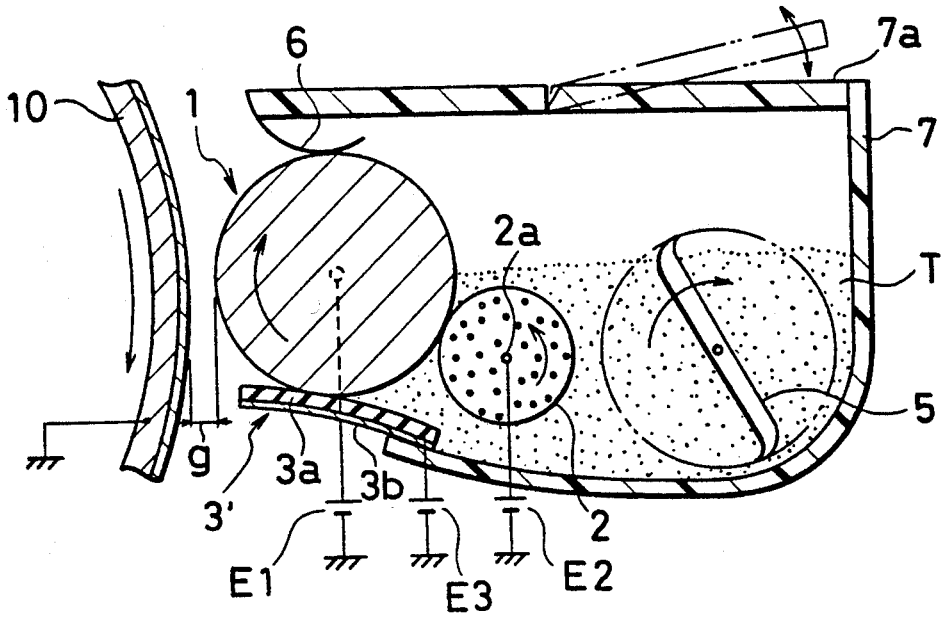
FIG. 15 is a cross section of a developer unit according to a ninth embodiment of the invention.

FIG. 15 is a cross section of a developer unit according to a ninth embodiment of the invention. In the developer unit of this embodiment, the conductive constraining member 3 comprises a constraining member 3' formed as a lamination of a non-conductive portion 3a and a conductive portion 3b, and a high voltage source E2 connected to the porous member 2 is separate from a high voltage source E3 which is connected to the conductive portion 3b of the constraining member 3. In other respects, the arrangement is similar to that of the first embodiment shown in FIG. 1 and accordingly, corresponding parts are designated by like reference numerals and characters and will not be described specifically.

The purpose of replacing the conductive constraining member 3 by the laminate 3' is to improve the useful life and the reliability of the resulting developer unit. Specifically, if a constraining member 3 is formed by a dispersion of conductive material therein or containing a conductive material deposited on or coated to the surface thereof which is disposed for contact with the developer holder 1 which carries the developer thereon, a mechanical abrasion will be caused in the surface of the constraining member 3 which is placed in contact with the developer holder 1, in particular, when the surface of the developer holder 1 is roughened. Where the constraining member 3 is formed by dispersion, there results a differential abrasion between the resin which represents a dispersion medium and the conductive material which represents a dispersed phase. Where the constraining member 3 is imparted with the electrical conductivity by deposition or coating, the deposited or coated layer may be abraded or may become exfoliated. In either instance, the stability of the charging and the formation of the thin layer will both depend on the quality of the constraining member 3, resulting in a degraded reliability and a reduced life of the developer unit.

The non-conductive portion 3a of the constraining member 3' is formed by a sheet of silicone rubber or urethane having a thickness on the order of 2 to 3 mm and hardness on the order of 60° to 80°, and the conductive portion 3b is applied to the opposite side thereof away from the side thereof which is disposed for abutment against the developer holder 1. The conductive portion 3b may be formed in a number of ways, including a coating of conductive material such as conductive carbon or metal filler on a resilient material which provides the nonconductive portion 3a, bonding a thin film of a metal such as copper, aluminium or stainless steel thereto by using a conductive adhesive such as a silver filler containing epoxy adhesive or carbon filler containing acrylic adhesive or evaporation of aluminium thereon.

On the side disposed for abutment against the developer holder 1, the non-conductive portion 3a exhibits a resistivity equal to or greater than $10^{13}$ Ω cm, and such insulating material is effective to prevent a leakage between the source E3 connected to the conductive portion 3b of the constraining member 3 and the source E1 connected to the developer holder 1, thus allowing the constraining member 3' and the developer holder 1 to be maintained at their respective high potentials.

In operation, the developer T which is charged by the porous member 2 will be formed into a thin layer on the developer holder 1 under the control of the constraining member 3' so as to have a thickness on the order of 20 to 40 μm. Even though the non-conductive portion 3a of the constraining member 3' is insulating, it has a dielectric constant, so that when a high voltage is applied to the conductive portion 3b of the constraining member 3' which is connected to the source E2, an induced charge will be developed on the side of the non-conductive portion 3a which is disposed for abutment against the developer holder 1, causing a charging by contact charging or triboelectric charging.

Figure 16A:
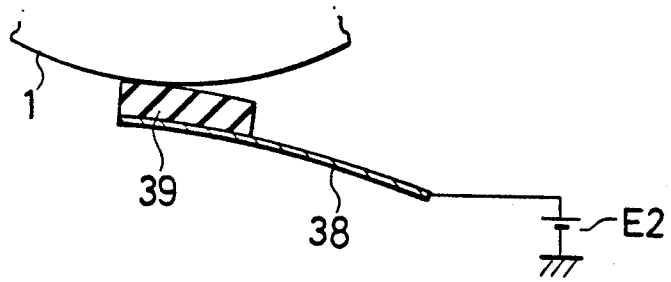
FIGS. 16(*a*), 16(*b*) 16(*c*) and 16(*d*) are a series of cross sections illustrating a sequential deformation of the constraining member shown in FIG. 15.
Figure 16B:
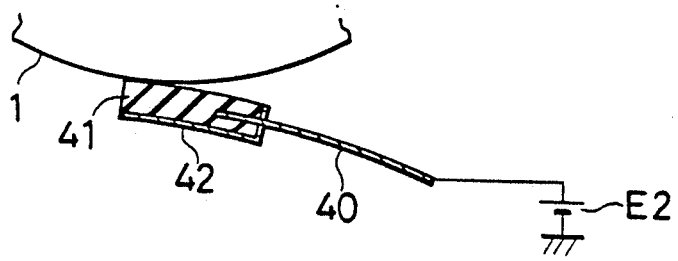
Figure 16C:
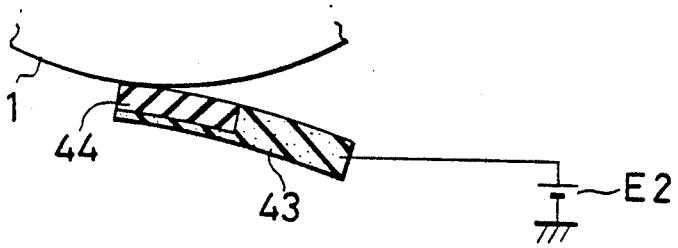
Figure 16D:
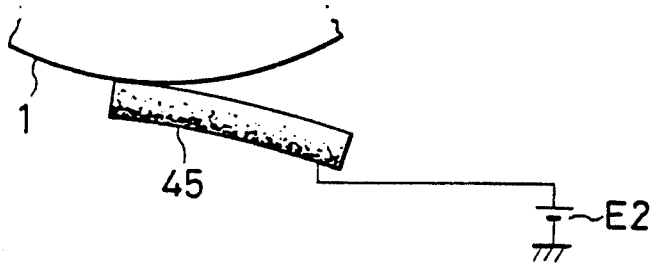

In FIG. 15, the entire constraining member 3' is formed as a laminate construction, but the construction of the constraining member 3' is not limited thereto, but may assume different configurations as indicated in FIGS. 16(a), (b), (c) and (d). As far as the side of the constraining member 3' which is disposed for abutment against the developer holder 1 is formed as a non-conductive portion 3a while the opposite side is formed with the conductive portion 3b, the requirement for a mechanical abutment against the developer holder 1 is satisfied. Specifically, in FIG. 16(a), the constraining member 3' comprises an insulating resin layer 39 applied to a resilient plate 38 which may be formed of a metal such as phosphor bronze or spring steel. In FIG. 16(b), the constraining member 3' comprises a similar resilient metal plate 40, to the free end of which is secured a block of resilient material 41 having a conductive material 42 formed on its surface. In FIG. 16(c), the constraining member 3' comprises a block of resilient conductive member 43 which may be formed by a sheet of silicone rubber or the like, having conductive material dispersed therein, and a portion of which that is disposed for abutment against the developer holder 1 is replaced by a block of an insulating material 44 which may be formed of silicone rubber that do not have a dispersion of conductive material therein. In FIG. 16(d), the constraining member 3' comprises a so-called graded function material 45 which is formed by a metal sheet as may be formed by chromium dioxide ($CrO_2$) on which a ceramic layer is grown as a crystal, with a high voltage being applied to the metal surface.

Figure 17:
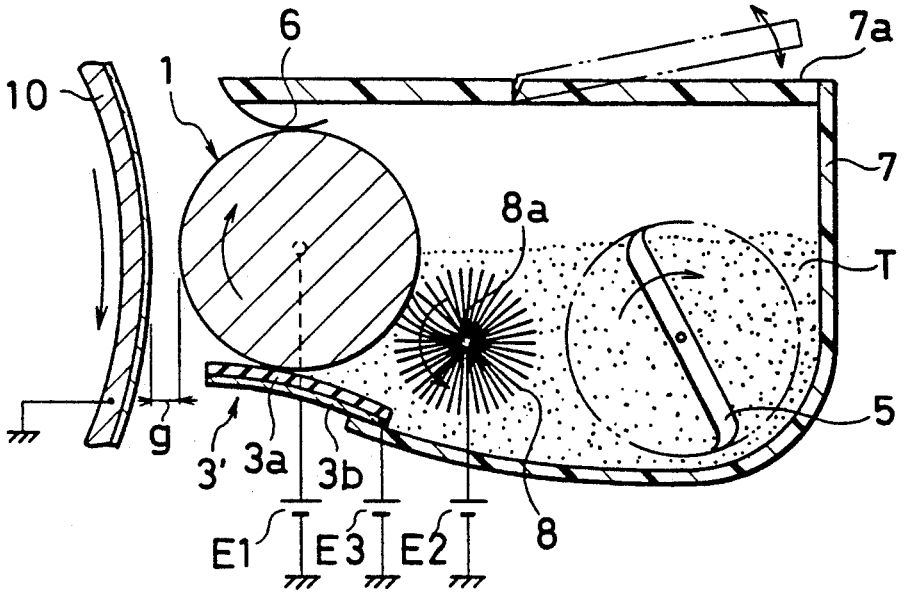
FIG. 17 is a cross section of a developer unit according to a tenth embodiment of the invention.

FIG. 17 is a cross section of a developer unit according to a tenth embodiment of the invention in which the porous member 2 is replaced by the fibrous conductive member 8. In other respects, the arrangement is similar to that of the ninth embodiment shown in FIG. 15, and accordingly, the corresponding parts are designated by like reference numerals or characters and will not be described specifically. This developer unit operates in substantially the same manner as the developer unit of the ninth embodiment shown in FIG. 15.

Figure 18:
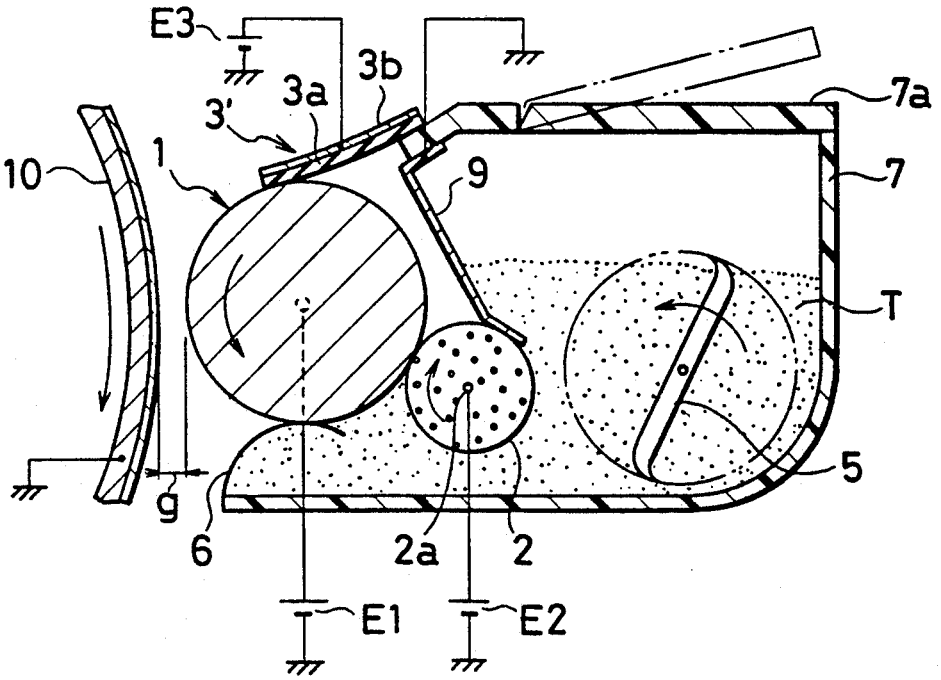
FIG. 18 is a cross section of a developer unit according to an eleventh embodiment of the invention.

FIG. 18 is a cross section of a developer unit according to an eleventh embodiment of the invention in which the direction of rotation of the developer holder 1 is reversed from that used in the ninth embodiment shown in FIG. 15. In other respects, the arrangement is similar to that of the ninth embodiment shown in FIG. 15, and accordingly, corresponding parts are designated by like reference numerals or characters and will not be described specifically.

In the developer unit of the eleventh embodiment, the constraining member 3' is disposed on top of the developer holder 1 while the anti-spill cover 6 is disposed on the bottom side thereof. In addition, a partition 9 similar to that used in the eighth embodiment shown in FIG. 14 is disposed on top of and above the porous member 2 located within the developer vessel 7. The developer unit of the eleventh embodiment operates substantially similar as the developer unit of the ninth embodiment shown in FIG. 15.

In the developer unit of the eleventh embodiment, it is possible to replace the porous member 2 by the fibrous conductive member 8 as in the tenth embodiment shown in FIG. 17.

The direction of rotation shown in this Figure of the porous member 2 is exemplary, and it may rotate in the opposite direction. In tis instance, it is preferred that the partition 9 be provided.

It is found by experiments that the developer units of the ninth to the eleventh embodiments produce favorable images under the same conditions as described for the developer units of the sixth to the eighth embodiments.

Figure 12B:
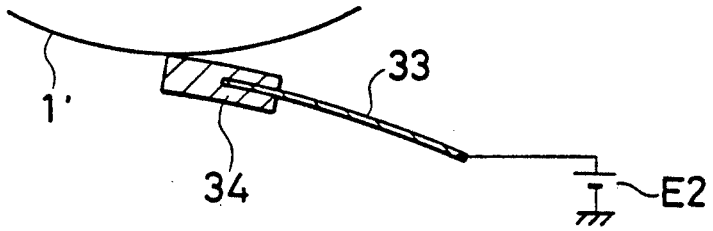
Figure 12C:
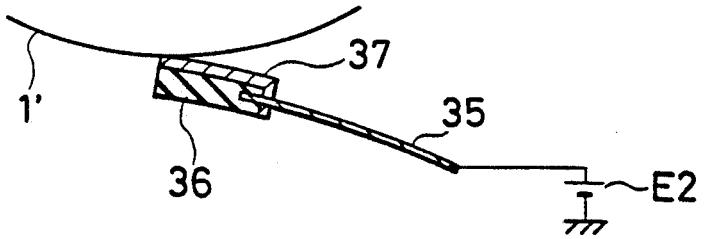
Figure 19:
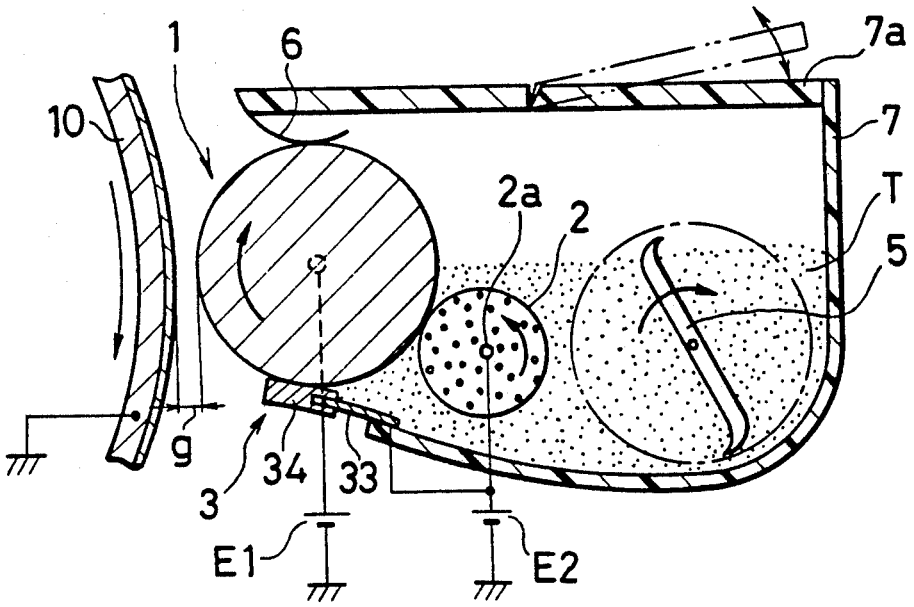
FIG. 19 is a cross section of a developer unit according to a twelfth embodiment of the invention.

FIG. 19 is a cross section of a developer unit according to an twelfth embodiment of the invention where the constraining member 3 is a composite of a resilient metal plate 33 and a conductive material 34 as shown in FIG. 12(b). In other respects, the arrangement is similar to that of the first embodiment shown in FIG. 1, and accordingly, corresponding parts are designated by like reference numerals or characters and will not be specifically described.

It should be understood that the developer unit of this embodiment operates substantially similarly as the developer unit of the first embodiment shown in FIG. 1.

The composite constraining member 3 may be replaced by a different composite constraining member 3 as shown in FIG. 12(a) or (c). The operation remains unchanged.

As in FIG. 5, the composite constraining member 3 may be disposed on top of the developer holder 1 while the spill cover 6 may be disposed along the bottom thereof. In addition, as in the second embodiment shown in FIG. 3, the porous member 2 may be replaced by the fibrous conductive member 8.

Figure 20:
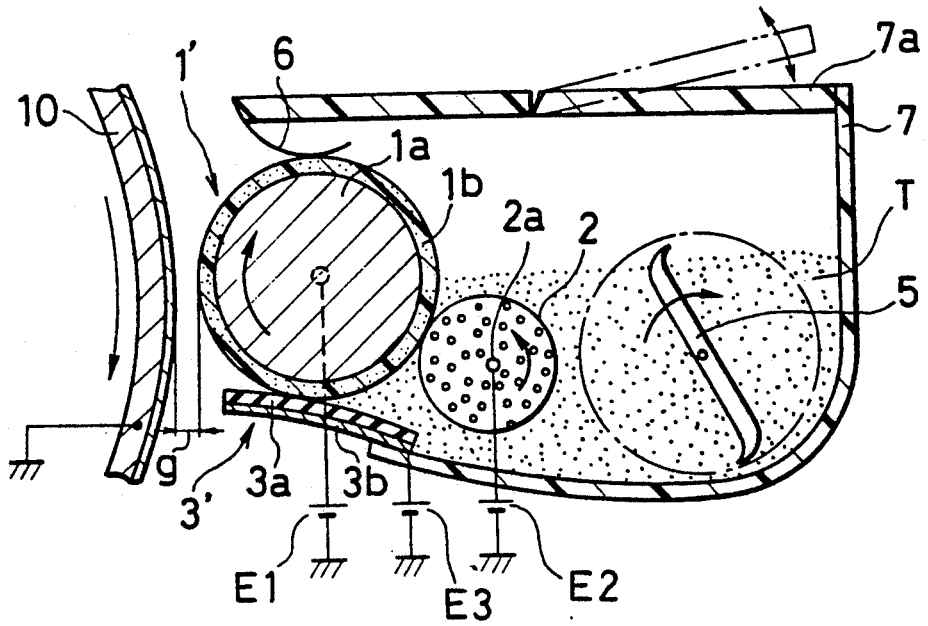
FIG. 20 is a cross section of a developer unit according to a thirteenth embodiment of the invention.

FIG. 20 is a cross section of a developer unit according to a thirteenth embodiment of the invention. In this embodiment, the developer holder 1 of the first embodiment shown in FIG. 1 is replaced by the developer holder 1' (see FIG. 7) of the fifth embodiment shown in FIG. 6, and the conductive constraining member 3 of the first embodiment is replaced by a constraining member 3' comprising a laminate comprising a non-conductive portion 3a and a conductive portion 3b. In addition, a high voltage source E2 which applies a high voltage to the porous member 2 is separate from a high voltage source E3 which applies a high voltage to the conductive portion 3b of the constraining member 3. In other respects, the arrangement is similar to that of the first embodiment shown in FIG. 1, and accordingly, corresponding parts are designated by like reference numerals or characters as used in FIG. 1 and will not be specifically described.

The developer unit of the thirteenth embodiment operates substantially similarly as the developer unit of the first embodiment shown in FIG. 1, but when the developer T is charged, it is supplied with charge from the porous member 2 to be electrostatically held attracted to the developer holder 1' and is charged in a stable manner by the induced charge which is developed at the non-conductive portion 3a of the constraining member 3 before it is conveyed into the developing zone.

In the developer unit of the thirteenth embodiment, the side of the constraining member 3' which is disposed for abutment against the developer holder 1' comprises the nonconductive portion 3a while the opposite side comprises the conductive portion 3b so that the charging and the formation of the thin layer of the developer T take place in a stable and reliable manner, assuring a stable and reliable image reproduction by the developer holder 1' which carries the conductive resin layer 1b.

In the developer unit of the thirteenth embodiment, the constraining member 3' may comprise a composite as shown in FIGS. 16(*a*) to (*d*), and in addition, the constraining member 3' may be disposed on top of the developer holder 1' while the anti-spill cover 6 may be disposed alongside the bottom thereof as shown in FIG. 5.

Figure 21:
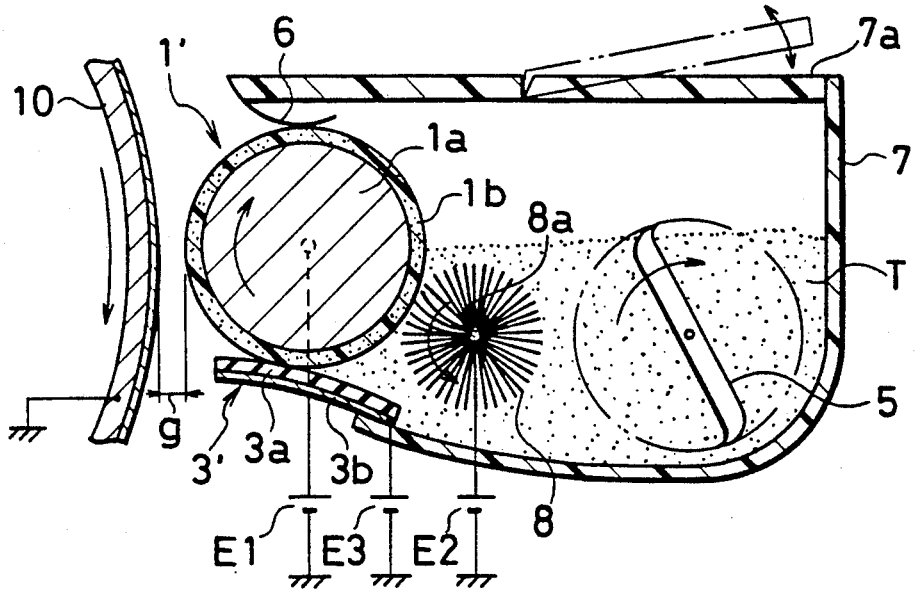
FIG. 21 is a cross section of a developer unit according to a fourteenth embodiment of the invention.

FIG. 21 is a cross section of a developer unit according to a fourteenth embodiment of the invention, in which the porous member 2 in the thirteenth embodiment shown in FIG. 20 is replaced by the fibrous conductive member 8. In other respects, the arrangement is similar to that of the thirteenth embodiment shown in FIG. 20, and accordingly, corresponding parts are designated by like reference numerals or characters and will not be described in detail.

The developer unit of the fourteenth embodiment operates in substantially the same manner as the developer unit of the thirteenth embodiment shown in FIG. 20.

In various embodiments described above, it is assumed that the developer unit uses a developer T which is charged to the positive polarity, but it should be understood that the invention is equally applicable to developer units where a developer T is charged to the negative polarity.

What is claimed is:

1. A developer unit receiving a non-magnetic single-component developer, the developer unit comprising:

a developer carrier having at least an electrically conductive core;

an electrically conductive constraining member in the shape of a sheet, abutting the developer carrier and serving for forming a substantially uniform thin layer of the developer on the developer carrier, an electrical developing bias being applied to the developer carrier to cause developer to fly across a gap to an image area of an electrostatic latent image formed on a latent image carrier opposed to the developer carrier; and further comprising:

an electrically conductive yieldable charging member rotatably disposed in physical contact with the developer carrier, a high voltage being applied to the charging member, the constraining member and the developer carrier, whereby the constraining member charges the developer on the developer holder to a predetermined potential.

2. A developer unit according to claim 1, wherein the yieldable charging member comprises a porous electrically conductive resilient member.

3. A developer unit according to claim 1, wherein the yieldable changing member comprises a fibrous electrically conductive member.

4. A developer unit according to claim 1 in which the developer holder carries a dielectric layer on its surface.

5. A developer unit according to claim 1 in which the constraining member comprises a composite of a conductive material and resilient material.

6. A developer unit according to claim 1, wherein the developer holder has a layer of conductive resin thereon.

7. A developer unit according to claim 5, wherein the constraining member includes a non-conductive portion disposed for abutment against the developer holder and also including a conductive portion on the opposite side, the constraining member controlling the thickness of a thin layer of developer formed on the developer holder and charging the developer to a given level; a high voltage being applied to each of the developer holder; the porous conductive resilient member and the conductive portion of the constraining member.

8. A developer unit as claimed in claim 6, in which the conductive resin layer has a thickness from 1.5 to 5.0 mm and a resistivity from $10^4$ to $10^{12}$ ohm-cm.

9. A developer unit according to claim 1, wherein the developer carrier conductive core is metallic.

10. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core;

a porous conductive resilient member disposed to be rotatable while maintaining a contact with the developer holder;

and a conductive constraining member in the shape of a sheet, abutting the developer holder and serving for controlling the thickness of a thin layer of developer formed on the developer holder and for charging the developer to a given level; a high voltage being applied to each of the developer holder, the porous conductive resilient member and the constraining member.

11. A developer unit according to claim 10 in which the developer holder carries a dielectric layer on its surface.

12. A developer unit according to claim 10 in which the constraining member comprises a composite of a conductive material and a resilient material.

13. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core;

a fibrous conductive member disposed to be rotatable while maintaining a contact with the developer holder;

and a conductive constraining member in the shape of a sheet, abutting the developer holder and serving for controlling the thickness of a thin layer of developer formed on the developer holder and for charging the developer to a given level; a high voltage being applied to each of the developer holder, the fibrous conductive member and the constraining member.

14. A developer unit according to claim 13 in which the developer holder carries a dielectric layer on its surface.

15. A developer unit according to claim 13 in which the constraining member comprises a composite of a conductive material and a resilient material.

16. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core with a coating of conductive resin layer thereon;

a porous conductive resilient member disposed to be rotatable while maintaining a contact with the developer holder;

and a conductive constraining member in the shape of a sheet, abutting the developer holder and serving for controlling the thickness of a thin layer of developer formed on the developer holder and for charging the developer to a given level; a high voltage being applied to each of the metal core of the developer holder, the porous conductive resilient member and the constraining member.

17. A developer unit according to claim 16 in which the constraining member comprises a composite of a conductive material and a resilient material.

18. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core having a coating of a conductive resin layer thereon;

a fibrous conductive member disposed to be rotatable while maintaining a contact with the developer holder;

and a conductive constraining member in the shape of a sheet, abutting the developer holder and serving for controlling the thickness of a thin layer of developer formed on the developer holder and for charging the developer to a given level; a high voltage being applied to each of the metal core of the developer holder, the fibrous conductive member and the constraining member.

19. A developer unit according to claim 18 in which the constraining member comprises a composite of a conductive material and a resilient material.

20. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core;

a porous conductive resilient member disposed to be rotatable while maintaining a contact with the developer holder;

and a constraining member including a non-conductive portion disposed for abutment against the developer holder and also including a conductive portion on the opposite side, the constraining member controlling the thickness of a thin layer of developer formed on the developer holder and charging the developer to a given level; a high voltage being applied to each of the developer holder, the porous conductive resilient member and the conductive portion of the constraining member.

21. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core;

a fibrous conductive member disposed to be rotatable while maintaining a contact with the developer holder;

and a constraining member including a non-conductive portion disposed for abutment against the developer holder and also including a conductive portion on the opposite side, the constraining member controlling the thickness of a thin layer of developer formed on the developer holder and charging the developer to a given level; a high voltage being applied to each of the developer holder, the fibrous conductive member and the conductive portion of the constraining member.

22. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core having a coating of conductive resin layer thereon;

a porous conductive resilient member disposed to be rotatable while maintaining a contact with the developer holder;

and a constraining member including a non-conductive portion disposed for abutment against the developer holder and also including a conductive portion on the opposite side, the constraining member controlling the thickness of a thin layer of developer formed on the developer holder and charging the developer to a given level; a high voltage being applied to each of the metal core of the developer holder, the porous conductive resilient member and the conductive portion of the constraining member.

23. A developer unit in which a non-magnetic single component developer is supplied to the surface of a developer holder and is formed into a uniform thin layer thereon by means of a constraining member, and in which a developing bias is applied to the developer holder to cause the developer to fly to an image area of an electrostatic latent image formed on a latent image carrier which is disposed in opposing relationship with the developer holder with a gap therebetween, comprising a developer holder formed of a metal core having a coating of conductive resin layer thereon;

a fibrous conductive member disposed to be rotatable while maintaining a contact with the developer holder;

and a constraining member including a non-conductive portion disposed for abutment against the developer holder and also including a conductive portion on the opposite side, the constraining member controlling the thickness of a thin layer of developer formed on the developer holder and charging the developer to a given level; a high voltage being applied to each of the metal core of the developer holder, the fibrous conductive member and the conductive portion of the constraining member.

* * * * *